US009247622B2

(12) United States Patent
Fredricks

(10) Patent No.: US 9,247,622 B2
(45) Date of Patent: Jan. 26, 2016

(54) LIGHTING CONTROL SYSTEMS

(71) Applicant: Dennis Fredricks, Escondido, CA (US)

(72) Inventor: Dennis Fredricks, Escondido, CA (US)

(73) Assignee: CURRENT-USA, INC., Vista, CA (US)

( * ) Notice: Subject to any disclaimer, the term of this patent is extended or adjusted under 35 U.S.C. 154(b) by 174 days.

(21) Appl. No.: 13/772,215

(22) Filed: Feb. 20, 2013

(65) Prior Publication Data

US 2014/0232294 A1 Aug. 21, 2014

(51) Int. Cl.
*H05B 37/02* (2006.01)

(52) U.S. Cl.
CPC ..... *H05B 37/029* (2013.01); *H05B 37/0245* (2013.01)

(58) Field of Classification Search
CPC ..... F24C 7/004; H05B 37/02; H05B 37/029
USPC ..... 315/291, 201
See application file for complete search history.

(56) References Cited

U.S. PATENT DOCUMENTS 6,039,702 A * 3/2000 Cutler ..... A61H 23/0263 601/15
6,292,901 B1 * 9/2001 Lys ..... A61N 5/0616 713/300
6,375,630 B1 * 4/2002 Cutler ..... A61H 23/0263 601/57
6,648,840 B2 * 11/2003 Cutler ..... A61H 23/0263 601/15
7,332,877 B2 * 2/2008 Crodian ..... B60Q 1/1423 315/292
7,352,339 B2 * 4/2008 Morgan ..... F24C 7/004 340/815.68
7,490,957 B2 * 2/2009 Leong ..... F21K 9/00 315/51
7,724,082 B2 * 5/2010 Park ..... H03F 3/217 330/10
8,502,480 B1 * 8/2013 Gerszberg ..... H05B 37/02 315/312
8,542,181 B2 * 9/2013 Smith ..... G09G 3/3406 315/169.3
2002/0111570 A1 * 8/2002 Cutler ..... A61H 23/0263 601/15
2002/0115946 A1 * 8/2002 Cutler ..... A61H 23/0263 601/57
2009/0003832 A1 * 1/2009 Pederson ..... H04B 10/1143 398/135
2009/0085500 A1 * 4/2009 Zampini, II ..... H05B 33/0857 315/297
2010/0084992 A1 * 4/2010 Valois ..... H05B 37/0254 315/291
2010/0327766 A1 * 12/2010 Recker ..... H02J 9/02 315/291
2012/0043889 A1 * 2/2012 Recker ..... H05B 33/0815 315/86
2012/0062123 A1 * 3/2012 Jarrell ..... H05B 37/0245 315/131
2012/0074843 A1 * 3/2012 Recker ..... H05B 33/0815 315/86
2012/0098432 A1 * 4/2012 Recker ..... H05B 33/0815 315/86
2012/0098439 A1 * 4/2012 Recker ..... H05B 33/0815 315/152
2012/0262068 A1 * 10/2012 Chi ..... H05B 33/0818 315/122
2013/0038218 A1 * 2/2013 Xu ..... G05B 15/02 315/151
2013/0221859 A1 * 8/2013 Pavelchak ..... F21S 8/035 315/159
2013/0293139 A1 * 11/2013 Sadwick ..... H05B 37/02 315/224
2014/0011245 A1 * 1/2014 Flynn ..... C12M 21/02 435/134

OTHER PUBLICATIONS

STIC search results.*
STIC search History.*

* cited by examiner

*Primary Examiner* — Tung X Le
*Assistant Examiner* — Srinivas Sathiraju

(57) ABSTRACT

A lighting control system and apparatus that may be utilized with aquariums are provided. The light control system and apparatus may be utilized with various lighting fixtures. The lighting control system and apparatus provides easy control over different lighting fixtures comprising various lighting sources. In addition, a user may program various lighting characteristics and effects such as the turn on or turn off date and time, the color, the brightness, the power supplied to the lighting fixtures via different user interfaces by using different user systems. Further, multiple lighting control systems may operate seamlessly together.

17 Claims, 6 Drawing Sheets

LIGHTING CONTROL SYSTEMS

FIELD OF THE INVENTION

The present invention relates to lighting control systems and, more particularly, some embodiments are directed toward lighting control systems used in conjunction with semiconductor light sources such as light-emitting diodes (LEDs) used in aquariums.

DESCRIPTION OF THE RELATED ART

A light-emitting diode (LED) is a semiconductor light source that may be used in many applications such as aquariums, holiday lights, indoor growing of plants, hatchery lightings, landscape lightings, pond lightings, etc. Nevertheless, the control over light sources is quite inflexible. Typically, users are required to turn on, turn off, or adjust light sources manually. Users cannot set up the time to turn on or turn off the light sources so that the light sources may be automatically turned on or off. Further, conventionally, it is quite inconvenient for users to adjust the brightness, color, or other lighting characteristics and effects of the light sources.

BRIEF SUMMARY OF EMBODIMENTS OF THE INVENTION

Various embodiments of the present invention provide a lighting control system and apparatus that may be utilized with various lighting fixtures. The features and functionality of the lighting control system and apparatus provide easy control over different lighting fixtures comprising various light sources. In addition, the features and functionality of some embodiments allow a user to program various lighting characteristics and effects such as the turn on or turn off date and time, the color, the brightness, the power supplied to the lighting fixtures via different user interfaces by using different user systems. Further, for some embodiments, features of the present invention allow multiple lighting control systems to operate seamlessly together.

The features and functionality of the lighting control system make various embodiments to be plug and play ready. In some embodiments, the lighting control system and apparatus provide a one touch button/control that allow a user to set on and off time, to choose a specific color blend to enhance the color of a fish species, to choose a location where the corresponding light source should be adjusted and how it should be adjusted, to choose a photoperiod, or to choose a dimming option.

It should be noted that although the present invention is described within the context of aquariums, it would be appreciated by those of ordinary skill in the art that various embodiments of the present invention may also be utilized in applications other than aquariums, such as in the fields of horticulture, holiday lights, hatchery lighting, landscape lighting, and pond lighting.

According to one embodiment, a lighting control system is provided. The lighting control system is configured to be coupled to a set of lighting fixtures, comprising: 1) a communication module that is configured to receive a set of instructions, 2) a memory coupled to the communication module, the memory storing the set of instructions, and 3) a processing module coupled to the memory, wherein the processing module adjusts a duty cycle of a PWM channel according to the set of instructions.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward a lighting control system and apparatus that may be utilized with aquariums. Various embodiments of the present invention provide a lighting control system and apparatus that may be utilized with various lighting fixtures. The features and functionality of the lighting control system and apparatus provide easy control over different light fixtures comprising various lighting sources. In addition, the features and functionality of some embodiments allow a user to program various lighting characteristics and effects such as the turn on or turn off date and time, the color, the brightness, and the power supplied to the lighting fixtures via different user interfaces by using different user systems. Further, for some embodiments, features of the present invention allow multiple lighting control systems to operate seamlessly together.

The features and functionality of the lighting control system make various embodiments to be plug and play ready. In some embodiments, the lighting control system and apparatus provide a one button control that allow a user to set on and off time, to choose a specific color blend to enhance the color of a fish species, to choose a location where the appropriate light sources should be adjusted and how they should be adjusted, to choose a photoperiod, or to choose a dimming option.

Before describing the invention in further detail, it may be useful to describe a few example environments in which various embodiments of the present invention can be implemented. One such example is that of illustrated in FIG. 1.

Figure 1:
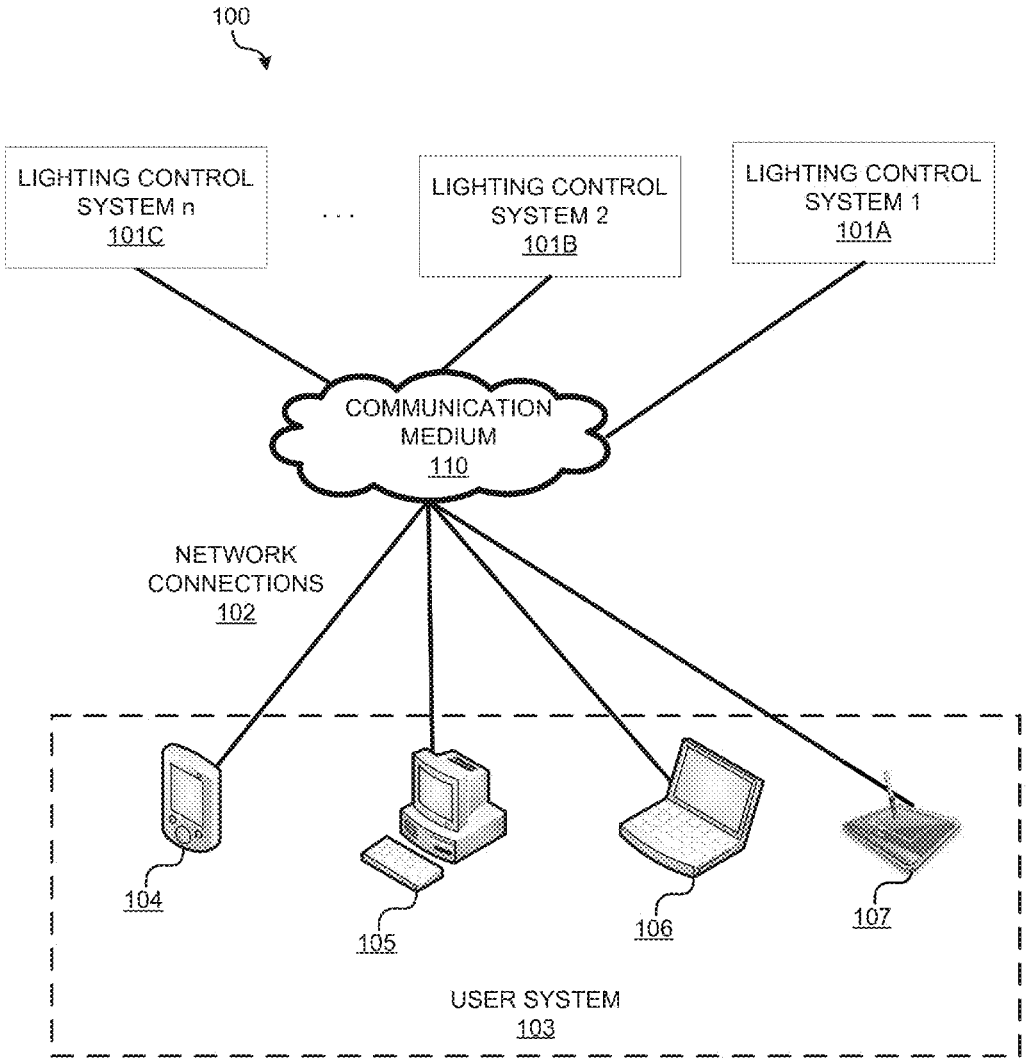
FIG. 1 is a diagram illustrating exemplary lighting control systems according to one embodiment of the present invention implemented in an example environment.

FIG. 1 illustrates exemplary lighting control systems 101A-101C in accordance with one embodiment of the invention, and implemented in an environment 100 comprising various user systems 103 connected to the lighting control systems 101A-101C via their respective network connection 102 via a communication medium 110. The communication medium 110 may be a wired system (e.g., a coaxial cable system, a fiber optic cable system, an Ethernet cable system), or a wireless network system (e.g., a wireless personal area network, a wireless local area network, a cellular network.)

As shown, various user systems 103 such as a smart phone 104 (e.g., iPhone®), a desktop computer 105, a laptop computer 106, and a tablet 107 (e.g., iPAD®), through their respective network connections 102, can either interact directly or indirectly with one or more of the n lighting control systems 101A-101C to control one or more lighting fixtures coupled to the lighting control systems. For example, a network connection 102 includes wired connections (e.g., Digital Subscriber Line (DSL), optical), wireless connections (e.g., Wi-Fi.) In various embodiments, a network connection 102 may include an ad hoc network, an intranet, an extranet, a virtual private network (VPN), a local area network (LAN), a wireless LAN (WLAN), a wide area network (WAN), a portion of the Internet, a portion of the Public Switched Telephone Network (PSTN), a cellular telephone network, or any combination thereof. A network connection 102 needs not necessarily be the same throughout the environment 100.

A lighting control platform can be hosted by the lighting control systems 101A-101C, which may be accessed by a user using any user system 103 (e.g., 104, 105, 106, and 107). The user system 103 can display any interface related to the lighting control system and allow a user to interact with the lighting control system thereby controlling or adjusting the light sources of the lighting fixture that are connected to the lighting control systems. For example, the user system 103 may be configured to receive an input from a user, to transmit the input to one or more lighting control systems of the n lighting control systems 101A-101C, and to receive status updates from the n lighting control systems 101A-101C. The interfaces may have different designs for different user systems 103. One of ordinary skill in the art will understand that other interfaces related to the lighting control may be created to facilitate the lighting control experience.

In one embodiment, a user may download a client component of a lighting control system. The client component may be executed locally at a user system 103, whereas the lighting control system may provide back-end support for the client component and may be responsible for maintaining the lighting control data, processing inputs from users, controlling one or more lighting fixtures, and transmitting instructions to various user systems 103. As illustrated, one or more lighting control systems 101A-101C may be connected to a communication medium and may operate seamlessly together.

Figure 2:
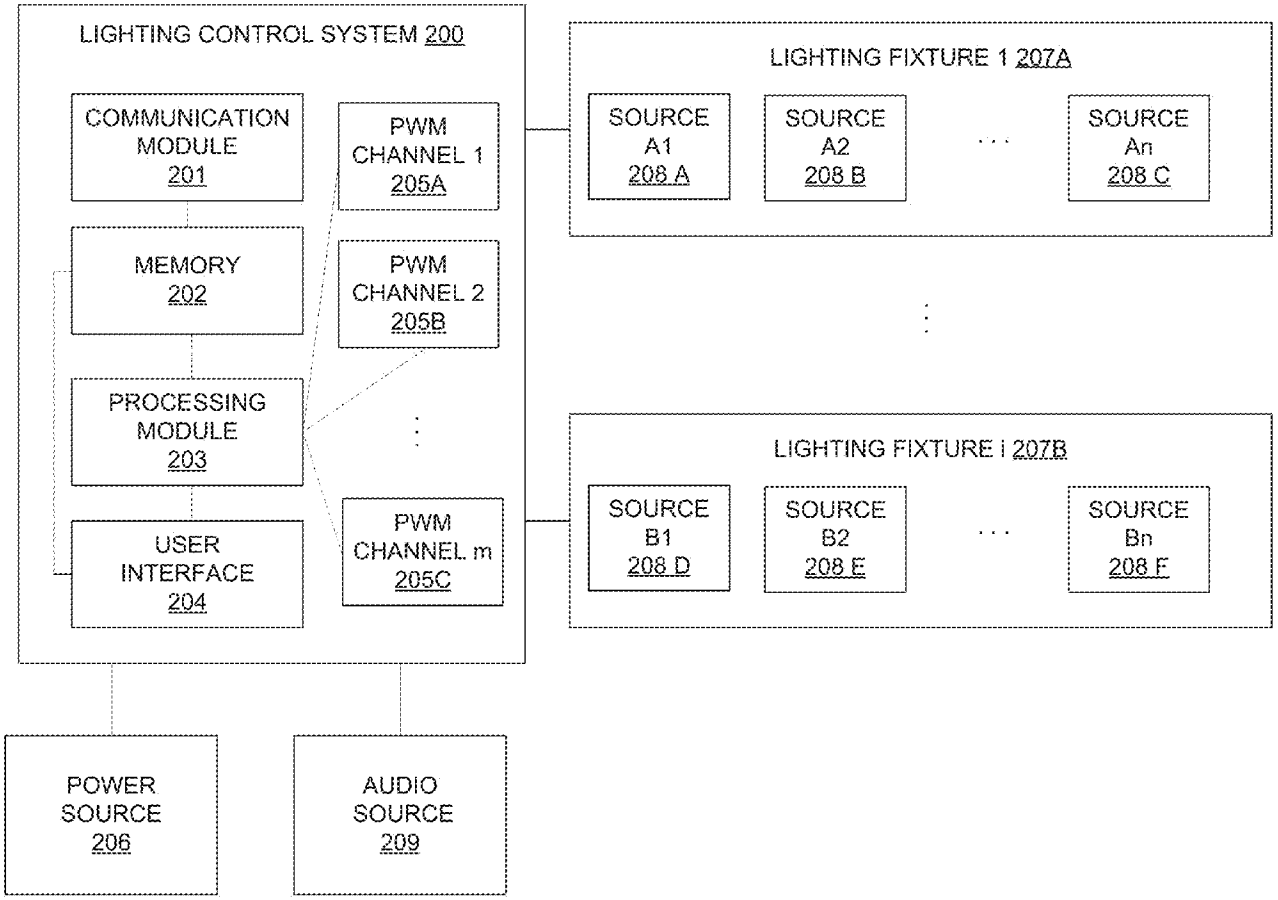
FIG. 2 is a diagram illustrating an example lighting control system in accordance with an embodiment of the invention.

FIG. 2 is a diagram illustrating an example lighting control system 200 in accordance with an embodiment of the invention. In various embodiments, the lighting control system 200 may comprise a communication module 201, a memory 202, and a processing module 203. The communication module 201 may be coupled to the memory 202. The processing module 203 may be coupled to the memory 202. In various embodiments, the memory 202 may be a non-volatile memory that may retain the stored information even when not powered, such as EEPROM/PROM(s). Accordingly, boot programs and basic input/output system (BIOS) programs are stored in the memory 202. In various embodiments, different components or modules of the lighting control system are mounted on a printed circuit board (PCB). In some embodiments, the lighting control system and different lighting fixtures may be mounted on the same PCB.

In some embodiments, the lighting control system 200 may comprise a user interface 204. The user interface 204 may be a graphical user interface (GUI), a web-based user interface (WUI), a touchscreen, a touch user interface, or other user interfaces through which a user may interact with the lighting control system 200. Via the user interface 204, a user may program how the lighting fixtures should be adjusted. In one embodiment, the lighting control system 200 comprises a one-touch button that allows a user to program lighting control instructions or commands. In other embodiments, the lighting control system 200 may comprise a remote control that facilitates a user to program lighting control instructions or commands. The remote control may communicate in various communication protocols such as Bluetooth, Zigbee, 802.11 protocols, Infrared (IR), Radio Frequency (RF), or any other wireless protocol. In some embodiments, a user may choose a color such as a specific color blend to enhance the color of a fish species or a color that reflects a mood, or to choose a location where the light source should be adjusted and how it should be adjusted.

In further embodiments, a user may also select how the lighting source should be turned on or turned off, such as the ramp-up time and intensity, the ramp-down time and intensity such as sun rise/sun set effects. In some embodiments, the user may select a color, a color combination, a dimming option, a photoperiod, or other lighting characteristics and effects. In one embodiment, the lighting control system 200 may be preloaded with a selection of lighting characteristics and effects such as commonly used lightings, which may be displayed on the user interface 204 for a user to select. In some embodiments, the lighting control system 200 may also comprise an internal calendar or an internal clock. As such, the lighting control system 200 may adjust the light sources according to date and time specified in the user's instructions.

The communication module 201 is configured to receive from or to transmit instructions to various user systems. In one embodiment, the communication module 201 may comprise a network interface controller that may connect the lighting control system 200 with a communication network which may be a wired system (e.g., a coaxial cable system, a fiber optic cable system, an Ethernet cable system), or a wireless network system (e.g., a wireless personal area network, a wireless local area network, a cellular network.)

In one embodiment, the processing module is coupled to the memory 202. In various embodiments, the processing module 203 is configured to process the user's instructions, which may be stored in the memory 202. When processing the instructions, the processing module 203 may generate PWM channel control signals. The processing module 203 may further adjust the duty cycles of the Pulse Width Modulation (PWM) channels accordingly. In some embodiments, the processing module 203 only adjusts the PWM channels that have connected lighting sources. In other words, the PWM channels that have no connected lighting sources will not be adjusted and will generate NULL output. In other embodiments, the lighting control system 200 may control various devices such as lighting fixtures, audio devices, air pumps, fish feeders, decoration devices.

As illustrated in FIG. 2, the lighting control system 200 may be connected between a power source 206 and one or more lighting fixtures (1–i) 207A-207B. The power source 206 may be a power adapter that converts the alternating current (AC) from power outlets into a 12-volt or 24-volt direct current (DC). In one embodiment, when one or more lighting fixtures 207A-207B are constant-voltage supplied, the lighting control system 200 adjusts the current supplied to them by adjusting the duty cycles of the corresponding PWM channels. The light sources 208A-208F comprised in the lighting fixtures 207A-207B may be configured with a light emitting diode (LED), an organic light emitting diode (OLED), a xenon bulb, a halogen bulbs, and an electroluminescent (EL) light source (e.g., an EL panel or film), or any combination thereof.

The lighting fixtures 207A-207B may be configured with a series of identically colored light sources that allow for variable light intensity. Various embodiments of the lighting control system 200 may calibrate the intensity and resolution of each light source and adjust the duty cycles of the PWM channels accordingly. The lighting fixtures 207A-207B may also be configured with RGB lighting systems, that is a series of blue, red, and green light sources that allow for different color blends. Moreover, the lighting fixtures 207A-207B may be configured with RGBW lighting systems, that is a series of blue, red, green, and white light sources that allow for different color blends. Each of the blue, red, green, and white light sources may be associated with a PWM channel of the lighting control system 200, and the lighting control system 200 adjusts the duty cycle of each PWM channel accordingly thereby creating different combination of colors.

Further, in some embodiments, the lighting control system 200 may be coupled to an audio source 209. In one embodiment, the lighting control system 200 is coupled to the audio source 209 via an audio jack. In one embodiment, the lighting control system 200 may comprise a sound sensor (not shown). The lighting control system 200 may regulate light supplied to the lighting fixtures 207A-B according to sound signals from the audio source 209. A user may select the sensitivity setting and the lighting control system 200 may adjust the light based on the selected sensitivity setting (for example, low, medium or loud volumes.) For example, the lighting fixtures 207A-B may flash to the rhythm of medium volume of the audio source 209.

Figure 3:
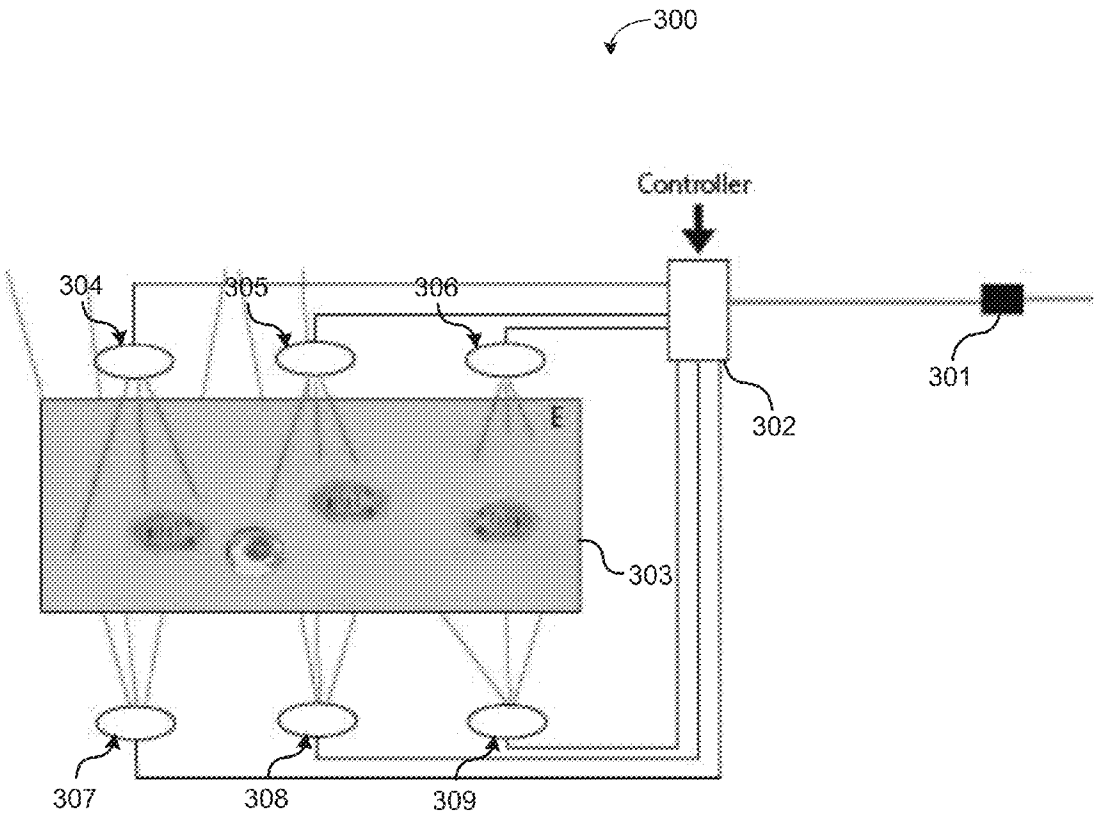
FIG. 3 is a diagram illustrating an example implementation of an example lighting control system in accordance with an embodiment of the invention.

FIG. 3 a diagram illustrating an example implementation 300 of an example lighting control system 302 in accordance with an embodiment of the invention. The illustrated implementation 300 comprises a transformer 301, the lighting control system 302, a fish tank 303, and lighting fixtures 304-309. Each lighting fixture may comprise a set of light sources (not shown). As illustrated, the lighting control system 302 may control multiple lighting fixtures at the same time. The lighting fixtures 304-309 may be the same or may be different. The lighting control system 302 may control the lighting fixtures 304-309 to create various lighting effects. For example, the lighting control system 302 may control the lighting fixtures 304-306 that are placed above the fish tank 303 to fade one by one from left to right. In various embodiments, the lighting control system 302 may comprise a remote control (not shown). A user may control various devices via the remote of the lighting control system 302, such as lighting fixtures, audio devices, air pumps, fish feeders, decoration devices. In one embodiment, a user may program the remote control such that each button of the remote control controls a corresponding light source or lighting fixture. The remote control may communicate with the lighting control system 302 in various communication protocols such as Bluetooth, Zigbee, 802.11 protocols, Infrared (IR), Radio Frequency (RF), or any other wireless protocol.

Figures 4A, 4B, 4C:
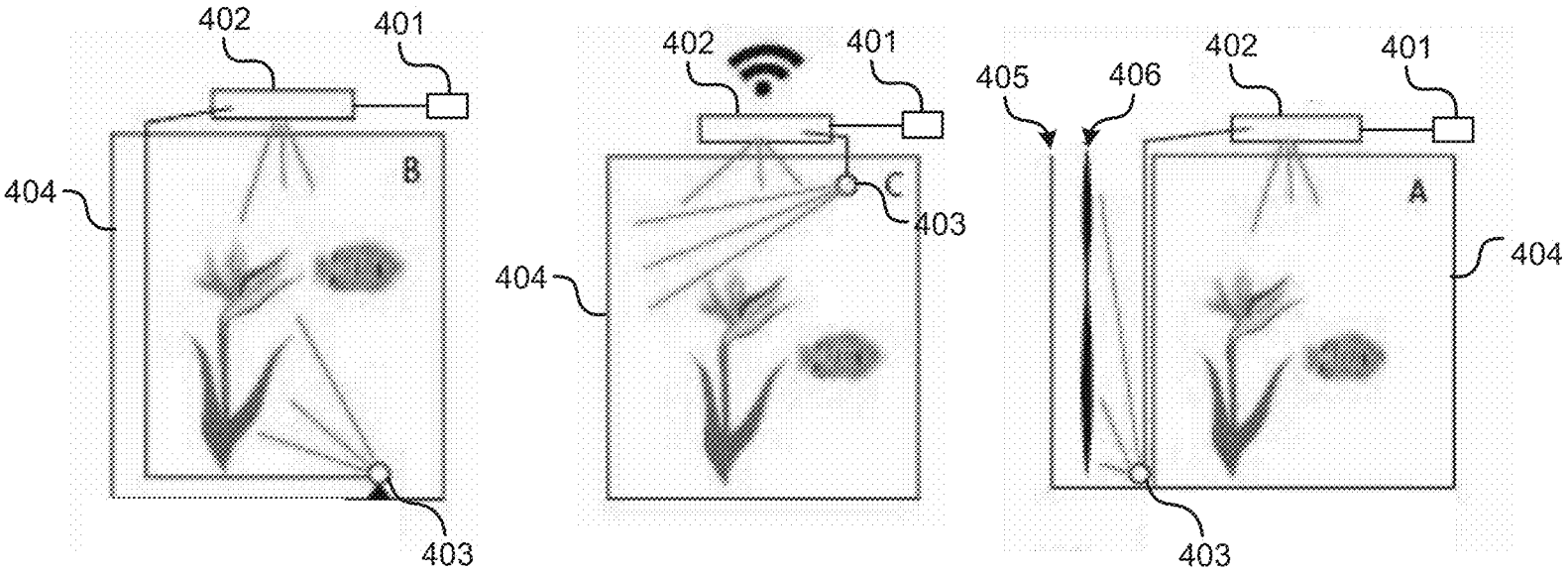
FIG. 4A is a diagram illustrating an example implementation of an example lighting control system in accordance with an embodiment of the invention.
FIG. 4B a diagram illustrating an example implementation of an example lighting control system in accordance with an embodiment of the invention.
FIG. 4C a diagram illustrating an example implementation of an example lighting control system in accordance with an embodiment of the invention.

FIGS. 4A-4C are diagrams illustrating exemplary implementations of an example lighting control system 401 in accordance with an embodiment of the invention. As illustrated in FIGS. 4A-4C, the lighting control system 401 may be implemented in connection with a lighting fixture 402. The lighting fixture 402 may comprise an accessory light 403 that may be coupled to the lighting fixture 402 via a jack, such as a headphone jack. The accessory light 403 may be a lighting fixture such as a light strip or a spotlight. The lighting fixture 402 and the accessory light 403 each may comprise a set of light sources. The lighting control system 401 may control both the lighting fixture 402 and the accessory light 402 according to a user's instruction. The lighting control system 401 may control the lighting fixture 402 and the accessory light 403 such that the lighting fixture 402 and the accessory light 403 may work in concert with each other. For example, the accessory light 403 may be complementary to the lighting fixture 402.

As illustrated in FIG. 4A, the accessory light 403 may be submersible in the fish tank 404. The accessory light 403 may function as landscape lighting. The accessory light 403 may also be placed above the water in the fish tank 404, as illustrated in FIG. 4B. Further, the accessory light 403 may be place outside the fish tank 404, as illustrated in FIG. 4C. In the illustrated example, a background insert 406 may be placed between the wall 405 and the fish tank 404 to create a theme, for example, beaches, forests, flowers, etc. The background insert 406 may be removed and inserted into a slot (not shown). The accessory light 403 may shine on the background insert 406 or on the wall 405 when the background insert 406 is removed.

Figure 5:
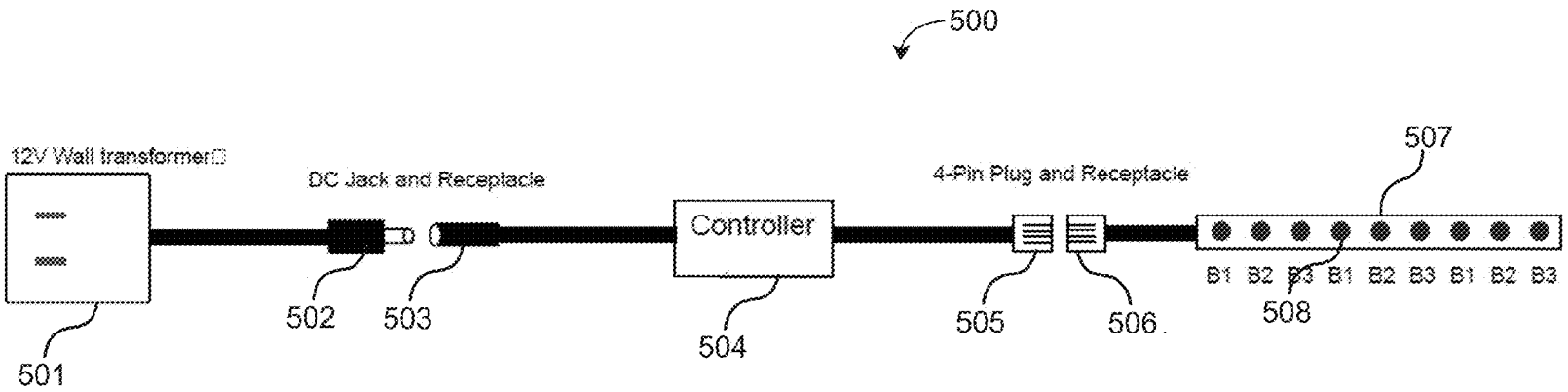
FIG. 5 is a diagram illustrating an example lighting control system in accordance with an embodiment of the invention.

FIG. 5 is a diagram illustrating a lighting control system 504 in accordance with an embodiment of the invention. The lighting control system 504 is implemented in a lighting system 500, which comprises a 12-volt wall transformer 501, and lighting fixture 507 comprising light sources 508. The lighting fixture 507 may be configured with a series of identically colored light sources (e.g., blue light-emitting diodes) that allow for variable light intensity, or a series of blue, red, and green light sources that allow for different color patterns. In the lighting system 500, the lighting fixture 507 is configured as a flexible light-emitting diode (LED) strip.

The lighting control system 504 may be used in some embodiments to control the behavior and parameters of the light sources 508 within the lighting fixture 507. For example, the lighting control system 504 may control the color pattern, light intensity, or timing of light patterns emitted from the lighting fixture 507. Additionally, the lighting control system 504 may be configured with a stop switch (not shown), which when engaged would cause the lighting control system 504 to stop or pause the logic the lighting control system 504 is performing through the lighting fixture 507.

Some embodiments are implemented with tool-less connectors that allow for easy removal and replacement. For example, in the lighting system 500, the system is configured with a direct current (DC) jack 502 and DC receptacle 503, allowing the wall transformer 501 to be easily disconnected from the lighting control system 504 without the need for tools. Further, the lighting control system 504 may be configured with a 4-pin plug 505 and receptacle 506, which allows the lighting control system 504 and/or the lighting fixture 507 to be easily connected or disconnected.

Figure 6:
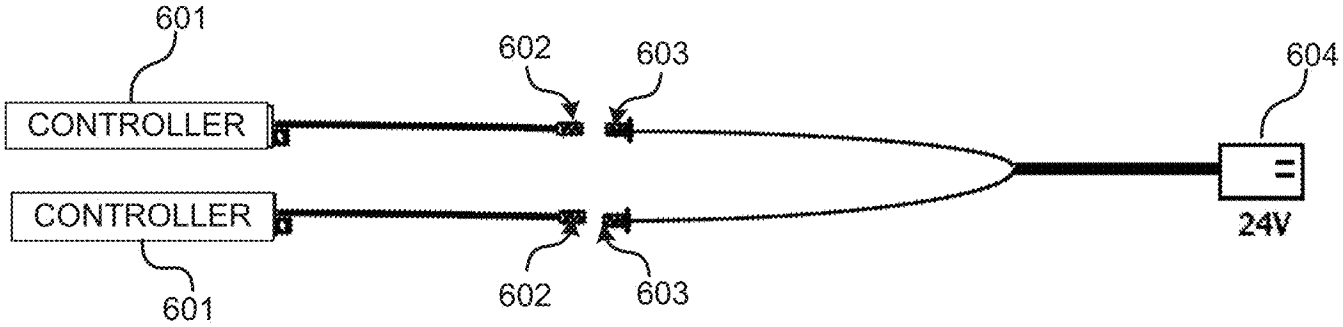
FIG. 6 is a diagram illustrating an example lighting control system in accordance with an embodiment of the invention.

In certain embodiments of the invention, the lighting control system may be further configured with male and/or female power connectors that allow multiple lighting control systems to be implemented together, either in parallel or in series. As illustrated in FIG. 6, each lighting control system 601 is configured with only a female DC receptacle 602, which can accept a male plug from a power supply unit 604. As such, two or more lighting control systems 601 may be connected to a single power supply unit 604 by using a splitter with male DC plugs 603.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A lighting control system configured to be coupled to a set of lighting fixtures, comprising:

a communication module configured to receive a set of instructions;

a memory coupled to the communication module, the memory storing the set of instructions; and a processing module coupled to the memory, the processing module adjusting a duty cycle of a PWM channel according to the set of instructions;

wherein the lighting control system is coupled to an audio source and the processing module adjusts the duty cycle of the PWM channel according to the audio source, whereby the lighting control system regulates light supplied to the lighting fixtures according to sound signals received from the audio source.

2. The lighting control system of claim 1, wherein the PWM channel corresponds to at least one light source of the set of lighting fixtures.

3. The lighting control system of claim 2, wherein a current to the at least one light source of the set of lighting fixtures is adjusted.

4. The lighting control system of claim 1, wherein the set of lighting fixtures comprising an RGB LED system comprising a red LED, a green LED, and a blue LED.

5. The lighting control system of claim 4, wherein the processing module further adjusts a second duty cycle of a second PWM channel and a third duty cycle of a third PWM channel according to the set of instructions, wherein the first PWM channel is associated with the red LED, the second PWM channel is associated with the green LED, and the third PWM channel is associated with the blue LED.

6. The lighting control system of claim 1, wherein the set of lighting fixtures comprises an LED strip.

7. The lighting control system of claim 1, wherein the communication module is configured to be coupled to a wireless router.

8. The lighting control system of claim 1, further comprising an internal clock.

9. The lighting control system of claim 1, wherein the set of instructions adjust a time, a color, a photoperiod, or a dimming option of an LED.

10. The lighting control system of claim 1, wherein the communication module is configured to receive the set of instructions from a WiFi network.

11. The lighting control system of claim 1, wherein the memory further stores a second set of instructions, further comprising a user interface, wherein the second set of instructions are configured to adjust a time, a color, a photoperiod, or a dimming option of an LED and wherein the user interface is configured to display the second set of instructions.

12. The lighting control system of claim 11, wherein the second set of instructions comprises a second instruction selecting a color complementing a fish species.

13. The lighting control system of claim 1, wherein the communication module, the memory, and the processing module are mounted on a printed circuit board.

14. The lighting control system of claim 12, further comprising a lighting fixture, wherein the lighting fixture is mounted on the printed circuit board.

15. The lighting control system of claim 1, wherein the set of lighting fixtures is employed to selectively light an aquarium.

16. The lighting control system of claim 1, wherein the set of lighting fixtures comprising an RGBW LED system comprising a red LED, a green LED, a blue LED, and a white LED.

17. The lighting control system of claim 1, wherein the set of instructions are infrared light signals, Bluetooth signals, or Radio Frequency signals.

* * * * *